US009080384B2

(12) United States Patent
Waleriańczyk et al.

(10) Patent No.: US 9,080,384 B2
(45) Date of Patent: Jul. 14, 2015

(54) PRESSURE BALANCED FLUID OPERATED REAMING TOOL FOR USE IN PLACING WELLBORE TUBULARS

(75) Inventors: Tomasz J Waleriańczyk, Aberdeen (GB); Edward D. Scott, Cardenden (GB); Wojciech Buczak, Aberdeen (GB)

(73) Assignee: Deep Casing Tools, Ltd., Aberdeen (GB)

( * ) Notice: Subject to any disclaimer, the term of this patent is extended or adjusted under 35 U.S.C. 154(b) by 560 days.

(21) Appl. No.: 13/476,119

(22) Filed: May 21, 2012

(65) Prior Publication Data

US 2013/0306376 A1 Nov. 21, 2013

(51) Int. Cl.

| | |
|---|---|
| ***E21B 4/00*** | (2006.01) |
| ***E21B 7/00*** | (2006.01) |
| ***E21B 4/02*** | (2006.01) |

(52) U.S. Cl.

CPC .... *E21B 7/00* (2013.01); *E21B 4/02* (2013.01)

(58) Field of Classification Search

CPC ..... E21B 21/103; E21B 21/10; E21B 7/00; E21B 4/02; E21B 4/00

USPC ..... 175/50, 57, 40, 195, 107

See application file for complete search history.

(56) References Cited

U.S. PATENT DOCUMENTS

| | | | | |
|---|---|---|---|---|
| 3,058,510 | A | 10/1962 | Tirasplovsky et al. | |
| 6,129,160 | A * | 10/2000 | Williams et al. | 175/107 |
| 6,279,670 | B1 * | 8/2001 | Eddison et al. | 175/107 |
| 7,086,486 | B2 * | 8/2006 | Ravensbergen et al. | 175/107 |
| 7,523,792 | B2 * | 4/2009 | El-Rayes et al. | 175/92 |
| 8,567,511 | B2 * | 10/2013 | Loree | 166/376 |
| 2004/0200642 | A1 * | 10/2004 | Downie et al. | 175/107 |
| 2009/0095528 | A1 * | 4/2009 | Hay et al. | 175/26 |
| 2011/0168447 | A1 * | 7/2011 | Scott et al. | 175/57 |
| 2011/0180326 | A1 * | 7/2011 | Scott et al. | 175/57 |
| 2012/0199398 | A1 * | 8/2012 | Davis et al. | 175/57 |

FOREIGN PATENT DOCUMENTS

WO WO 2010037992 A1 * 4/2010

* cited by examiner

*Primary Examiner* — Kenneth L Thompson
*Assistant Examiner* — Michael Wills, III
(74) *Attorney, Agent, or Firm* — Richard A. Fagin

(57) ABSTRACT

An apparatus for cutting a wellbore includes a motor having a stator and a rotor. The rotor has an output shaft connected to a cutting structure. The stator and rotor are spaced radially outwardly of the axis of rotation of the rotor such that at least one of the stator and the rotor had an access bore extending through the motor to adjacent the cutting structure. A further object can pass therethrough, without obstruction. The further object comprises a further cutting. A flow diverter is disposed in the motor proximate a connection between the motor and a wellbore tubular, and has a first fluid outlet in fluid communication with a power section of the motor, and a second fluid outlet in fluid communication with the access bore. The flow diverter is coupled to the stator such that axial loading created by fluid pressure is substantially transferred to the stator.

12 Claims, 4 Drawing Sheets

PRESSURE BALANCED FLUID OPERATED REAMING TOOL FOR USE IN PLACING WELLBORE TUBULARS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

U.S. Pat. No. 8,074,742 issued to Scott et al. discloses a reaming tool for use during emplacement of tubular strings such as casing or liner in wellbores drilled through subsurface formations.

A rotary power section described in the above referenced patent may include a turbine section operated by flow of drilling or other fluid through an interior of the wellbore tubular being emplaced so that a reaming head can rotate without rotation of the wellbore tubular. It has been observed that fluid pressure used to operate the rotary power section may place large axial loading on bearings included in the power section to support such loading. It is desirable to have a reaming tool power section for use in emplacement of wellbore tubular that has more balanced axial loading resulting from fluid pressure.

SUMMARY

An apparatus for cutting a wellbore according to one aspect includes the apparatus a motor having a stator and a rotor. The rotor has an output shaft connected to a cutting structure so as to drive the cutting structure. The stator and rotor are spaced radially outwardly of the axis of rotation of the rotor such that at least one of the stator and the rotor is formed with an access bore that extends through the motor to a position adjacent the cutting structure. A further object can pass therethrough, without obstruction from the stator and rotor. The further object comprises a further cutting structure of the apparatus. A flow diverter is disposed in the motor proximate a connection between the motor and the wellbore tubular, the flow diverter having a first fluid outlet in fluid communication with a power section of the motor, the flow diverter having a second fluid outlet in fluid communication with the access bore. The flow diverter is coupled to the stator such that axial loading created by fluid pressure is substantially transferred to the stator.

Other aspects and advantages will be apparent from the description and claims which follow.

DETAILED DESCRIPTION

Most of the details of operating a fluid powered reaming tool for use with inserting a casing or liner into a wellbore drilled through subsurface formations are set forth in U.S. Pat. No. 8,074,742 issued to Scott et al. and incorporated herein by reference. Relevant portions of the foregoing patent will be set forth below to explain operation of a pressure balanced rotary power unit for a reaming tool used with inserting casing or liner into a wellbore.

Figure 1:
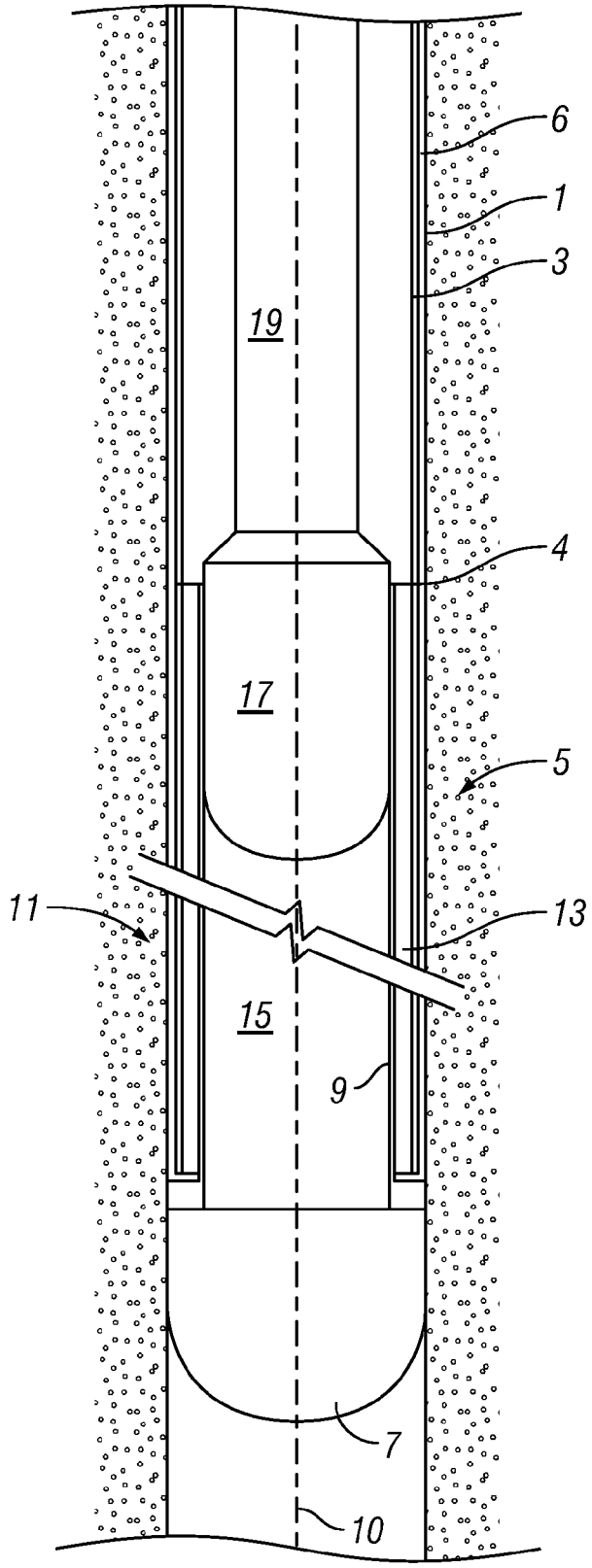
FIG. 1 is a sectional side view of an example reaming tool including an annular rotary power section

FIG. 1 shows a lower part of a wellbore 1 formed by a prior drilling operation. The wellbore 1 is being lined or already has been lined with a "string" of wellbore tubulars in the form of a casing 3 (or a liner) having a lowermost end 4. An annular space 6 is defined between the outer surface of the casing 3 and the wall of the wellbore 1. The annular space 6 may be filled with cement once drilling and reaming operations are complete.

A reaming tool 5 comprises a cutting structure which, in this example, may be a reamer shoe 7 connected to an output shaft 9. Rotation of the output shaft 9 rotates the reamer shoe 7. In this example the reamer show 7 can be sacrificed by drilling or reaming after the casing 3 (or liner) is moved to its intended depth in the wellbore 1.

The output shaft 9 comprises a rotor of a motor generally indicated at 11. The rotor 11 in this example may be radially inward of a radially outward stator 13 fixedly connected to the lowermost end 4 of the casing 3.

The stator 13 may be concentric with and extends around the periphery of the output shaft 9 and may thus be of hollow tubular form when viewed from the side or in transverse cross section. The stator 13 is therefore radially spaced from the rotational axis 10 of the output shaft 9 such that it does not, when viewed in cross section from the side, extend across the output shaft 9. The output shaft 9 may be formed with an access bore 15 that extends along the length of the motor 11 from the reamer shoe 7 to the opposite, distal longitudinal end of the output shaft 9, that is, the longitudinal end adjacent the lowermost end 4 of the casing 3. The access bore 15 in this example may be co-axial with the axis of rotation 10 of the output shaft 9. The access bore 15 may also extend in a direction aligned with but not co-axial with, the axis of rotation 10.

The access bore 15 may have an internal diameter selected to receive and enable free passage therethrough of a further object and may arranged such that the further object can be located directly adjacent the reamer shoe 7. The further object could comprise any desired device which may include, for example, a sensing device to transmit a signal indicative of physical parameters relevant to the cutting process. In the example, the further object may comprise a further cutting structure comprising a drill bit 17 connected to a drill pipe, pipe string or coiled tubing, shown generally at 19.

In using the apparatus 5, the casing 3 is moved through the wellbore 1, which has already been drilled to a selected depth in the subsurface. The motor 11 may be activated to drive the output shaft 9 to rotate the reamer shoe 7 by pumping fluid through an interior of the casing 3 or liner. Rotating the reamer shoe 7 aids movement ("running") of the casing 3 into the wellbore 1 to the selected depth.

Once the casing 3 has reached the selected depth, the motor 11 may be deactivated. The drill bit 17 and drill string 19 may then run be into the casing 3. When the drill bit 17 reaches the lowermost end 4 of the casing 3, the drill bit 17 may be moved into the access bore 15 of the output shaft 9 so as to effectively pass through the interior of the motor 11, i.e., the functional parts of the motor are radially outward of the output shaft 9 and drill bit 17 and do not obstruct passage of the drill bit 17 toward the reamer shoe 7. The motor workings do not therefore require drilling out or removal to allow the drill bit 17 access to the reamer shoe 7.

When the drill bit 17 reaches the reamer shoe 7, rotation of the drill bit 17 allows the drill bit 17 to cut through the sacrificial reamer shoe 7 so as to project beyond the reamer shoe 7 so as to move into contact with material to be drilled through to form a subsequent section of wellbore.

Figure 2:
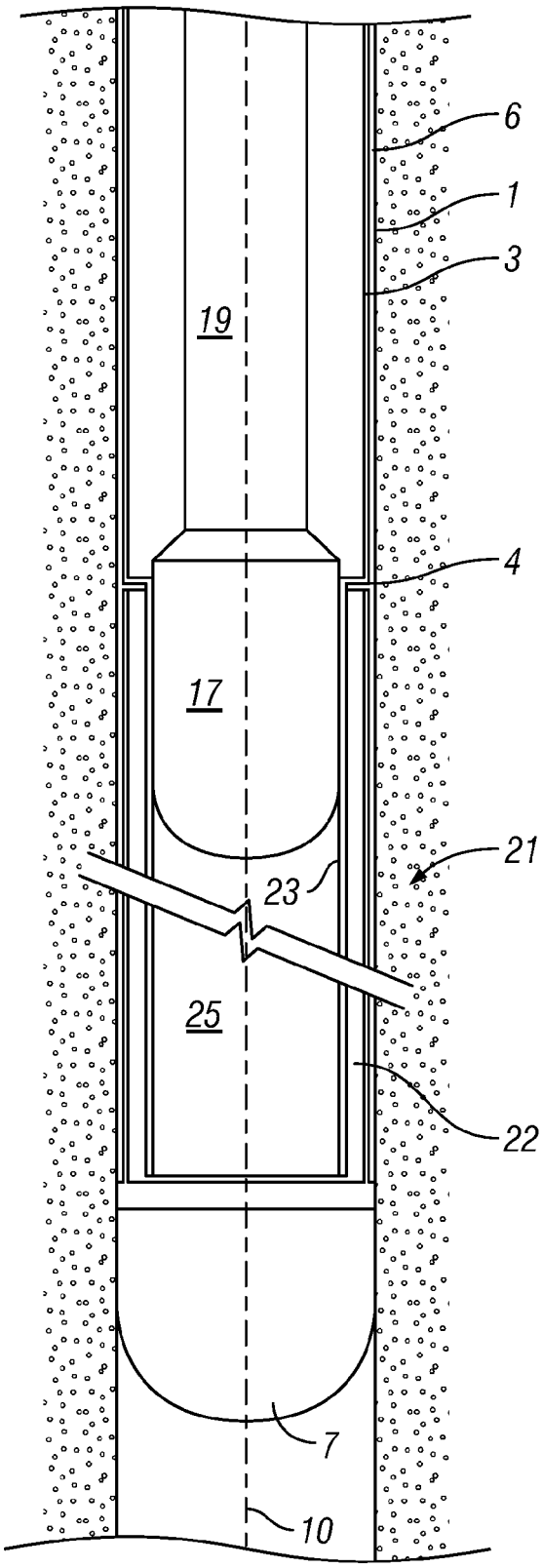
FIG. 2 is another sectional side view of the reaming tool of FIG. 1.

Referring to FIG. 2 another example reaming tool 21 is shown with like features being given like references to the reaming tool 5 described above. In the present example a modified output shaft 22 is concentric with and is radially outward of the motor stator. In the present example the motor stator may comprise a radially inward tubular stator 23 fixed to the lowermost end 4 of the casing 3 or liner. The tubular stator 23 may be formed with an access bore 25 that extends from the reamer shoe 7 to the lowermost end 4 of the casing 3, in the present example co-axially with the axis of rotation 10 of the modified output shaft 22. A further object, which in this example again comprises the drill bit 17 and drill pipe 19, may be run into the access bore 25 in the tubular stator 23.

Figure 3:
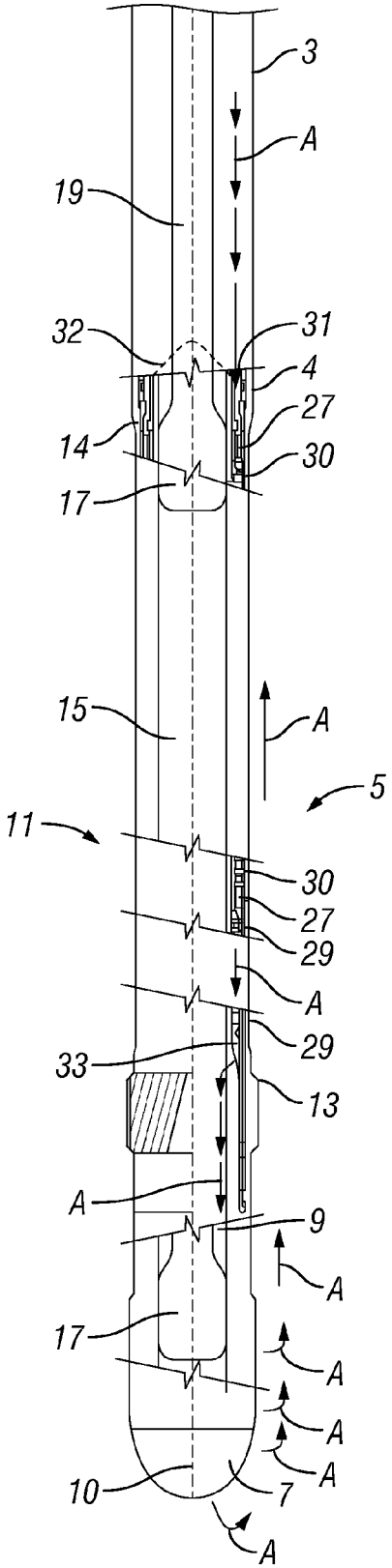
FIG. 3 is a more detailed part sectional, part cut away side view of the reaming tool of FIG. 1 showing a further cutting structure in two consecutive positions, with part of the apparatus in phantom.

Referring to FIG. 3 a flared portion 14 of the radially outward stator 13 may be rotationally locked to an interior surface of the lowermost end 4 of the casing 3. Such locking can be achieved using any suitable locking means.

The radially inward output shaft rotor 9 may be rotatably mounted on the stator 13 using a suitable combination of rotational bearings 27. Additionally a plurality of axial thrust bearings 29 may provided to limit axial movement between the rotor 9 and the stator 13 while still allowing relative rotation of these components. The thrust bearings 29 can be arranged to allow limited axial movement if desirable.

Any desired type, number and position of bearings may be used as required to deal with the loads generated. The motor rotor 9 and stator 13 can comprise any desired structure and components to generate power to rotationally drive the rotor 9. In this example, the rotor 9 and stator 13 together comprise a turbine arrangement wherein the rotor 9 comprises turbine blades 30 arranged to deflect fluid pumped between the rotor 9 and stator 13 so as to convert some of the energy of the fluid into rotation of the rotor 9 and hence the reamer shoe 7.

The stator 13 comprises a fluid inlet 31 between the stator 13 and the internal rotor 9, at the lowermost end 4 of the casing 3, the fluid inlet 31 being radially outwardly spaced from the axis 10.

A flow diverter 32 (shown in phantom) is provided adjacent the fluid inlet 31 and serves to divert fluid pumped down the casing 3 radially outwardly so as to flow into the fluid inlet 31.

The fluid flow path is indicated by arrows 'A'. Having been diverted by the flow diverter, the fluid enters the inlet 31 adjacent the lowermost casing end 4. The fluid is pumped in a direction generally parallel to the axis of rotation 10 of the rotor 9 in the void defined between the concentric rotor 9 and stator 13, and subsequently exits the void and the turbine arrangement radially inwardly through the outlet 33 into the access bore 15. The fluid then travels along the access bore 15 and subsequently generally radially outwardly and/or downwardly through jetting apertures (not shown) formed in the reamer shoe 7. The fluid thus functions as a lubricant for the reamer shoe 7 before being forced up the annular space 6 between the casing 3 and the wellbore 1.

Figure 4:
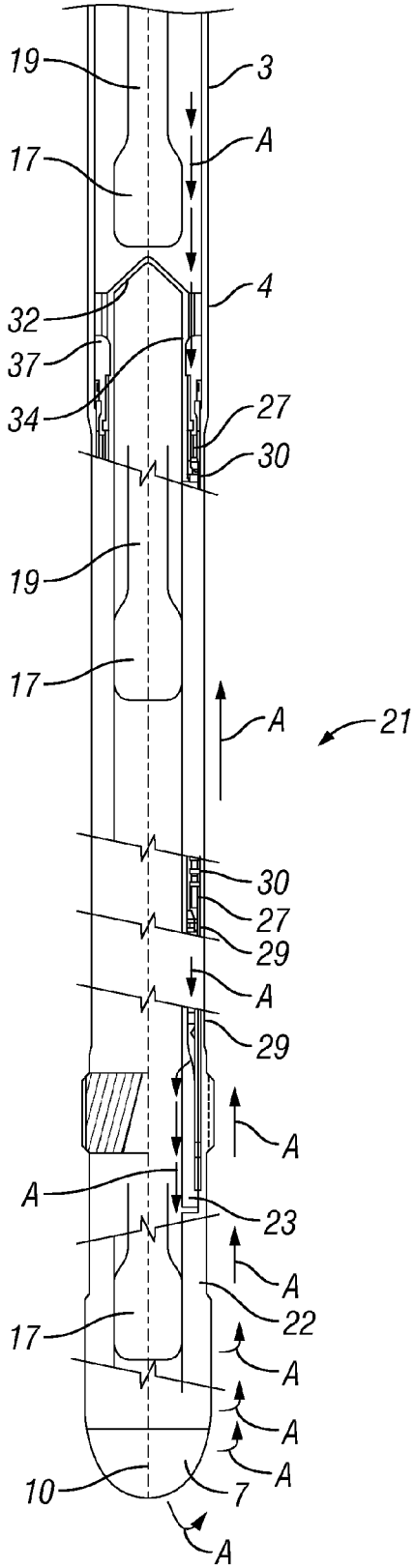
FIG. 4 is a more detailed part sectional, part cut away side view of the reaming tool of FIG. 2 showing a further cutting structure in three consecutive positions.

Referring additionally to FIG. 4, a flared portion 37 of the radially inward stator 23 of the second described reaming tool (in FIG. 2) 21 may be locked to the interior surface of the lowermost end 4 of the casing 3. This can again be achieved using any suitable locking means.

The bearings, turbine arrangement and fluid flow path are otherwise similar to those described above with reference to FIG. 3. In each example, the bearings could be lubricated by the fluid used to drive the turbine arrangement. In each example, the rotor of the motor could be integral with the output shaft or that these could comprise separate components connected together. Likewise it is possible that the output shaft may be integral with the cutting structure or that these could comprise separate components connected together, e.g., by threaded couplings of types known in the art.

Figure 5:
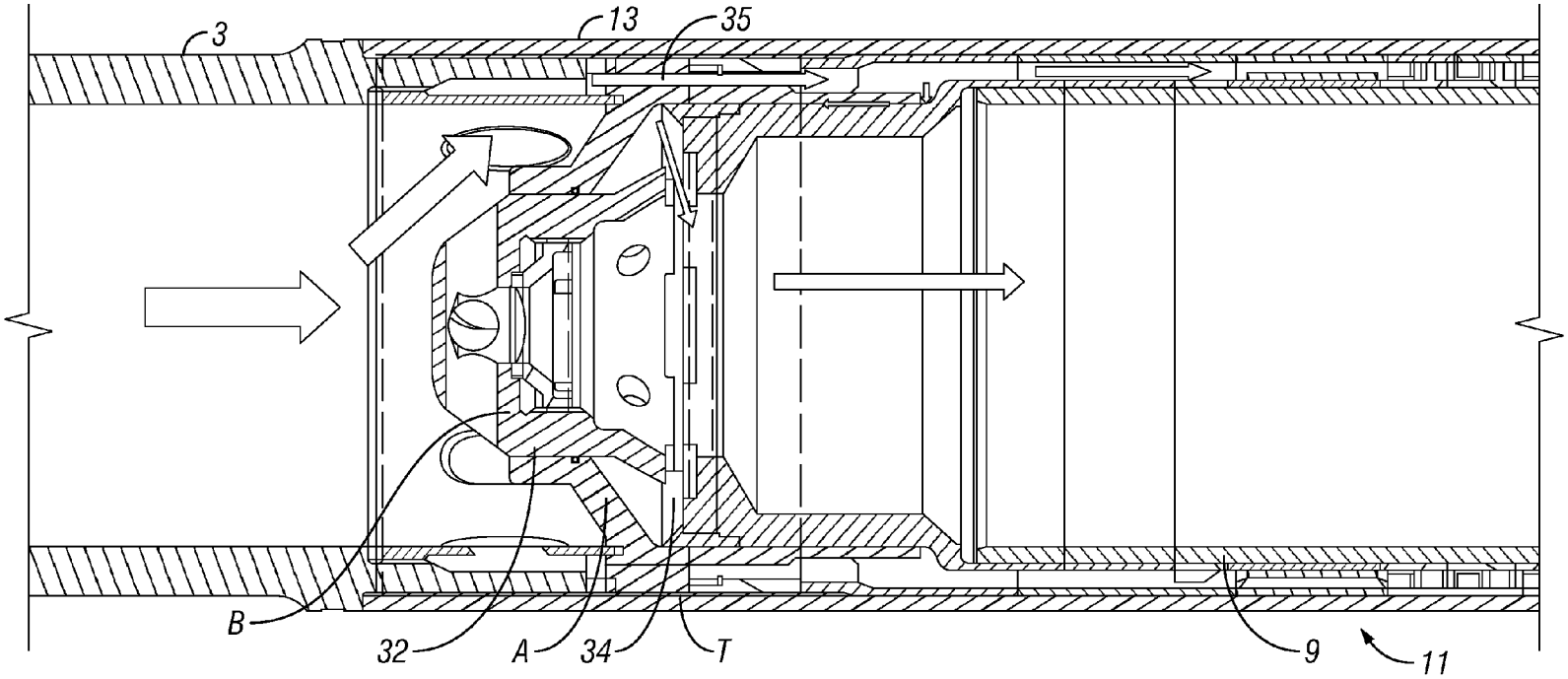
FIG. 5 shows a flow diverter inside the reaming tool to provide fluid flow to both the rotary power section (turbine) and to an interior of the reaming tool and reaming head.

As explained in the Background section herein, the axial thrust bearings (e.g., 29 in FIG. 3) are subject to loading resulting from pressure drop in the motor. Referring to FIG. 5, a portion of an example motor in a reaming tool is shown having balanced fluid pressure that may relieve some of the pressure-induced axial loading. The reaming tool motor section shown in FIG. 5 may be configured with an external stator 13 and internal output shaft (rotor) 9 as in FIG. 1. It should be understood that the motor arrangement of FIG. 2 may be used to the same effect. In FIG. 5, the flow diverter 32 may be configured to have a first fluid outlet 35 that directs part of the fluid flow from within the casing 3 or liner into the motor 11. A second fluid outlet 34 directs another part of the fluid flow from within the casing into the interior of the output shaft 9 (i.e., the access bore), and thence to the reamer shoe (7 in FIG. 1). If a motor such as shown in FIGS. 2 and 4 is used, the second fluid outlet will direct the other part of the fluid flow into the interior of the stator (23 in FIG. 4), i.e., the access bore, and thence to the reamer shoe 7 through a suitable bearing and flow crossover arrangement (not shown).

In the drilling or reaming of a wellbore with a motor which uses fluid flow as a power source there is a pressure drop through the motor. This pressure drop acts against the top most end of the rotary power output shaft in the manner of acting against a piston.

The cross sectional area of the equivalent piston is generally considered to be a function of the inside diameter of the body of the tool. This cross sectional area multiplied by the pressure drop through the motor is translated into an axial load through the motor which acts against any bearing system in the motor for carrying axial load. The pressure drop caused axial loading may be substantial.

The motor section shown in FIG. 5 seeks to reduce the hydraulically caused axial loading by manipulation of the effective piston area under hydraulic pressure. As the fluid passes through the motor 11 assembled to the output shaft 9 and reaches the axial end of the motor 11 there will be an associated pressure drop. The lowered pressure is also present at the cross section of the upper part of the output shaft 9. By way of explanation, there are essentially two piston areas. There is a primary piston area created by parts 'B' & 'A', this piston area is connected by threads T to the body 13. The primary piston area carries the majority of hydraulically induced pressure loading by carrying this load through into the body 13 and not into the axial bearings. A secondary or minor piston area is created by the cross section of the rotor blade area. There are circumferentially positioned axial bypass ports in part A, which allows the drilling fluid to enter into the motor 11. The motor 11 has a smaller effective piston area than parts B & A combined. In this way axial load reduction may be reduced up 80% of that of an uncompensated system.

It can be understood that as the annular motor has a relatively small cross section as contrasted with the output shaft there will be a resultant reduction in hydraulic load imparted to the axial thrust bearings while still maintaining a desired relatively high pressure without detriment to produced power and hole cleaning efficiency when the drilling fluid is ported to the wellbore annulus (6 in FIG. 1). This reduction in axial loading which is imparted to the axial bearing of the power output shaft facilitates a reduction in the number of bearing sets required to carry the axial loading efficiently.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. An apparatus for cutting a wellbore, the apparatus comprising:

a motor having a stator and a rotor, the rotor comprising an output shaft connected to a cutting structure so as to drive the cutting structure in use, wherein the stator and rotor are spaced radially outwardly of the axis of rotation of the rotor such that at least one of the stator and the rotor is formed with an access bore that extends through the motor to a position adjacent the cutting structure and through which, in use, a further object can pass, without obstruction from the stator and rotor such that the stator and rotor do not therefore require drilling out or removal to allow the further object access to the cutting structure, the motor coupled to a lower end of a wellbore tubular; and a flow diverter disposed in the motor proximate a connection between the motor and the wellbore tubular, the flow diverter having a first fluid outlet in fluid communication with a power section of the motor, the flow diverter having a second fluid outlet in fluid communication with the access bore, the second fluid outlet configured such that a lowered pressure at a fluid outlet of the motor is also present at a cross section of an upper part of the output shaft, the flow diverter coupled to the stator and having a piston area related to an equivalent piston area of the motor such that axial loading created by fluid pressure is substantially transferred to the stator.

2. The apparatus of claim 1, wherein the access bore extends substantially the length of the motor.

3. The apparatus of claim 1, wherein the access bore is coaxial with the axis of rotation of the rotor.

4. The apparatus of claim 1, wherein the cutting structure is a sacrificial cutting structure, the further cutting structure operative to cut through the sacrificial cutting structure.

5. The apparatus of claim 1, wherein the motor is arranged so as to be entirely positioned, in use, and when viewed in transverse cross section, between the exterior of the access bore and the interior of the wellbore.

6. The apparatus of claim 1, wherein the output shaft is integral with the cutting structure.

7. The apparatus of claim 1, wherein the output shaft is concentric with and radially outward of the stator.

8. The apparatus of claim 7, wherein the access bore is formed in the stator.

9. The apparatus of claim 1, wherein the output shaft is concentric with, but radially inward of the stator.

10. The apparatus of claim 9, wherein the access bore is formed in the output shaft.

11. The apparatus of claim 1, wherein the motor comprises a turbine arrangement comprising fluid engaging blades on at least the rotor to convert fluid flow through the motor into rotation of the rotor.

12. A method for cutting a wellbore, comprising:

driving an apparatus into a wellbore;

controlling a motor of the apparatus to rotate an output shaft of a rotor of the motor connected to a cutting structure so as to drive the cutting structure into the wellbore to a selected depth, wherein a stator and the rotor of the motor are spaced radially outwardly of an axis of rotation of the rotor such that at least one of the stator and the rotor is formed with an access bore that extends through the motor to a position adjacent the cutting structure;

wherein the controlling the motor comprises pumping fluid through a power section of the motor disposed between the stator and rotor, the pumping fluid comprising diverting fluid flow into an upper part of the motor into a first flow path into the power section and a second flow path into an interior of the access bore, the second flow path configured such that a lowered pressure at a fluid outlet of the motor is also present at a cross section of an upper part of the output shaft and wherein the diverting flow comprises applying fluid pressure to a piston area related to an equivalent piston area of the motor such that the flow diverting causing axial force created thereby to be coupled to the stator such that the axial force is substantially transferred to the stator.

* * * * *